United States Patent [19]

Fleming

[11] 4,035,686

[45] July 12, 1977

[54] NARROW EMISSION SPECTRUM LAMP USING ELECTROLUMINESCENT AND PHOTOLUMINESCENT MATERIALS

[75] Inventor: Gordon R. Fleming, Hanover, N.H.

[73] Assignee: Atkins & Merrill, Incorported, Lebanon, N.H.

[21] Appl. No.: 657,978

[22] Filed: Feb. 13, 1976

[51] Int. Cl.[2] ..... H05B 33/02; H05B 33/14

[52] U.S. Cl. ..... 313/503; 313/504; 313/507; 313/512

[58] Field of Search ..... 313/507, 504, 512, 506, 313/503

[56] References Cited

U.S. PATENT DOCUMENTS

| | | | |
|---|---|---|---|
| 2,924,732 | 2/1960 | Lehmann | 313/506 |
| 3,052,810 | 9/1962 | Mash | 313/506 |
| 3,167,677 | 1/1965 | Fremuth | 313/506 X |
| 3,510,732 | 5/1970 | Amans | 313/501 X |
| 3,593,055 | 7/1971 | Geusic et al. | 313/501 |

FOREIGN PATENT DOCUMENTS

| | | | |
|---|---|---|---|
| 746,181 | 11/1966 | Canada | 313/507 |
| 986,029 | 3/1965 | United Kingdom | 313/507 |

*Primary Examiner*—Palmer C. Demeo
*Attorney, Agent, or Firm*—Robert F. O'Connell

[57] ABSTRACT

A lamp assembly for providing light emission only over a selected portion of the visible spectrum which lamp assembly includes an electroluminescent means for emitting light over a predeterminable range of the visible spectrum which includes such selected portion. The lamp assembly further includes a first fluorescent means which absorbs light emitted by the electroluminescent means over another portion of the predeterminable range which does not include the selected portion thereof and emits the absorbed light over the desired selected portion. Additional light emitted by the electroluminescent means over still other portions of the visible spectrum can be prevented from emission from the lamp assembly by the use of a suitable filter therefor or by the use of an additional fluorescent means which absorbs such additional light and emits such absorbed light over the portion of the spectrum in which light is absorbed by the first fluorescent means.

14 Claims, 7 Drawing Figures

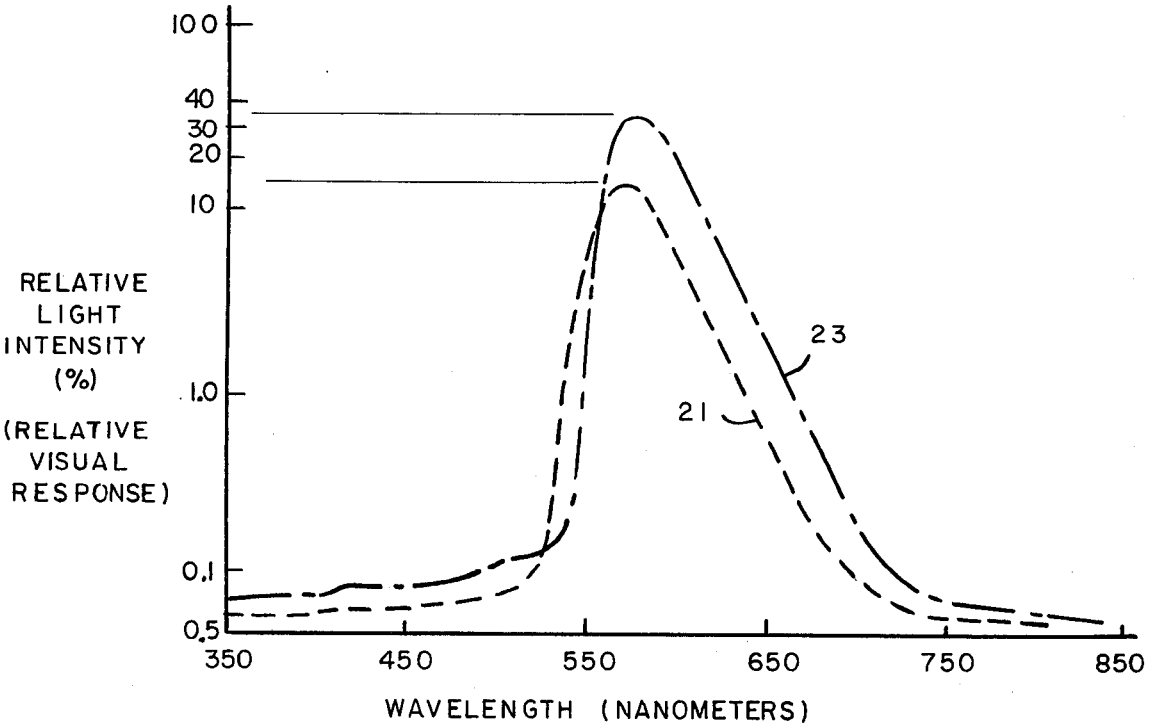
FIG.6
FIG.2
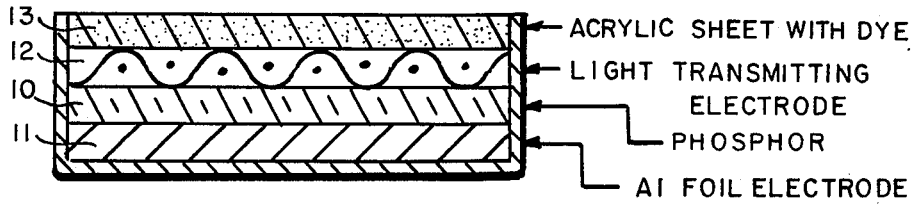
FIG.3
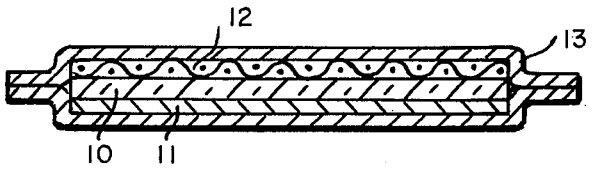
FIG.7
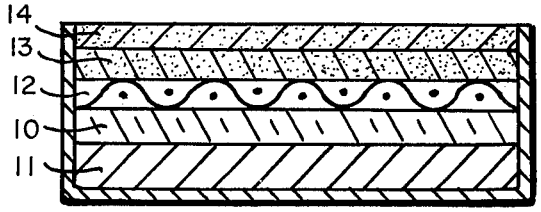

NARROW EMISSION SPECTRUM LAMP USING ELECTROLUMINESCENT AND PHOTOLUMINESCENT MATERIALS

INTRODUCTION

This invention relates generally to lamps which are useful in film development processing and, more particularly, to lamps utilizing electroluminescent and photoluminescent techniques for such purposes.

BACKGROUND OF THE INVENTION

Photographic film has the characteristic that its spectral sensitivity distribution is such that the film is substantially insensitive to light having frequencies within certain narrow regions of the visible spectrum in contrast to the spectral sensitivity distribution of the human eye which is relatively sensitive to visible light in such narrow regions. Illumination by the use of lamps which emit light only in such narrow regions may therefore be employed during the manufacture and process of such film without damage thereto. Lamp fixtures which provide such narrow band illumination are often called "safe-lights" by those in the photographic industry.

DESCRIPTION OF THE PRIOR ART

Conventional photographic safelights usually consist of a light source, such as a tungsten filament bulb of relatively low wattage, e.g. 15 watts, mounted within a housing having an opening for emitting light therefrom, the opening being covered by a suitable filter. The filter is typically a gelatin type overlay which is affixed to a glass plate mounted over the housing opening, although solid glass filters or other types of filters are sometimes used. Such filters, for example, are manufactured by Eastman Kodak Company, Rochester, New York under the designation "Wratten Safelight Filters."

Various types of photographic films which are insensitive to the light emitted by such filters can be processed if specific Wratten filters are selected to match the spectral characteristics of the film. For example, Eastman color print film type 5385 may be processed using an Eastman series No. 8 Wratten safelight filter.

Safelights manufactured in accordance with the above described structure have several disadvantages. Incandescent lamps normally have a relatively short life and are subject to so-called catastrophic failures, that is, the bulb totally fails instantaneously, the bulb life not being readily predictable for any given sample thereof. Thus, while incandescent bulbs are relatively inexpensive, the cost of labor which must be employed in replacing them may be very costly. In order to guard against total lamp failure in a critical location of a film processing plant and in order to conform to organized maintenance schedules, for example, it is often necessary for users thereof periodically to replace all lamps in a complete facility, whether or not such lamps are in operable condition. Over an extended period of time, the overall cost of replacement parts and labor can become substantial.

Further, the need to narrow the relatively broad emission spectrum of the incandescent bulb to the narrow distribution necessary for use as a safelight requires extremely dense, relatively opaque filters. The light loss through such filters is relatively substantial and such safelights are characteristically low intensity devices. Moreover, typical fixtures utilizing such lamps suffer from extremely non-uniform illumination over their emitting surfaces. Thus, a typical commercial fixture may utilize a half cylindrical reflector housing within which a 15 watt incandescent bulb is asymmetrically located. An 8 × 10 inches filter is placed over the opening of the reflector housing and, during illumination, the light appears from the filter side as a single bright spot opposite the bulb whereas the remaining surface is relatively dark. Similarly, the light cast by the fixture is non-uniform and creates hot spots of higher than average intensity, along with regions of undesirably low intensity.

Continued use of such fixtures often results in discoloration of the region of the filter which is substantially adjacent to the bulb, the filter being crazed with myriad cracks in a star-burst effect, for example, or even being burned or blistered so that light leaks are created, unfiltered incandescent light outside of the permissible narrow spectral distribution thereby being emitted. Such light leakage thereupon fogs and damages the film. Such condition is often aggravated by the efforts of users who employ bulbs of greater wattage than recommended in an effort to compensate for the poor light distribution of such lamps. Such efforts result in even more substantial quantities of heat being emitted by the incandescent bulbs and an aggravation of damage done to the filter. Further, efforts to compensate for the nonuniform emission have been used in which specially designed fixtures and housings are employed to provide some measure of internal reflections for such purpose. Such housings are often bulky, awkward to handle and often at variance with the space available for mounting, so that mounting becomes effectively impossible or is greatly inconvenient. Moreover, the heavy glass filters which are used pose a hazard to users in breakage, especially since the devices are used in low light level areas where human sight is at a disadvantage. The cleaning-up of breakage may be hazardous due to the darkness and the nature of the premises where such lamps are employed.

Moreover, the ambient atmosphere of film processing plants in regions where the lamps are used is often quite corrosive to conventional safelight structures since it involves the use of various chemicals in the process of film development. The corrosion of wiring and sockets and lack of good seals on conventional commercial safelights, along with the substantial temperatures associated with incandescent bulbs and fixtures, often produce lamp failures.

In an effort to overcome the above disadvantages, it has been suggested that electroluminescent lamps be utilized. Such lamps use a layer of light-producing phosphors sandwiched between two conductive layers, one being conductive and light reflecting and the other being conductive and light transmitting. A typical electroluminescent phosphor might be composed of zinc sulfide containing a nominal amount of copper. Such a device emits a light when a source of alternating current is supplied across the electrodes, the light being emitted relatively uniformly over the surface whether the lamps have a small or a large area. The intensities obtainable with electroluminescent lamps seem comparable to those obtainable with commercial incandescent safelights. The total output in lumens is a function of the area of the lamp so that the total luminous flux of an electroluminescent lamp may well exceed that of an incandescent-filter combination type of safelight.

Moreover, while electroluminescent lamps are generally less efficient than unfiltered incandescent lamps, the efficiency thereof can greatly exceed that of a filtered incandescent safelight. No temperature problems arise with electroluminescent lamps, since they are, in effect, "cold" light sources having surface temperatures usually negligibly above ambient, nor do such lamps need special power supplies to operate since they operate from commonly available voltage and frequency sources. Generally, the lamps themselves, as well as the lead wires and connectors associated therewith, can be encapsulated against moisture and corrosive chemicals. Further, they can be made in rigid or flexible form without the use of glass and may be relatively easily mounted directly to a wall or ceiling or other surface without requiring large and bulky fixtures. Moreover, such lamps gradually decay in brightness over relatively long periods of time, so they do not normally suffer from catastrophic failures, and it becomes possible to predict the time when a predetermined minimum light output will be reached so that a program of lamp replacement in a large processing plant can be relatively easily implemented.

Unfortunately, electroluminescent lamps, while nominally emitting in specific color bands, produce characteristic wide band Gaussian spectral emission. Even electroluminescent lamps with the narrowest of spectral distribution characteristics produce spectral emission bands which are far broader than the spectral distrbutions of commercial safelights. Consequently, an electroluminescent lamp with an emission peak suitably located with respect to the characteristics of the film being processed nevertheless can fog the film being processed.

If such lamps are used in conjunction with filters, such as are used in incandescent safelight structures, in order to narrow their emision spectral distribution, the amount of light which is emitted thereby is considerably reduced and the total light loss may be as high as 90% of the light present at the electroluminescent source. Accordingly, electroluminescent lamps in their present form have normally not been deemed suitable for use in safelight applications.

SUMMARY OF THE INVENTION

This invention provides a lamp of the electroluminescent type which is useful in safelight applications and which overcomes the foregoing difficulties in the use of incandescent filter lamp combinations, as well as the difficulties which arise in the use of electroluminescence techniques. In accordance with the invention, a combination of electroluminescent and photoluminescent techniques are utilized to provide a desired narrow emission spectral distribution to avoid light emission outside narrowly defined regions so that, in safelight applications, no fogging of film being processed occurs.

The use of the electroluminescent lamps in conjunction with photoluminescent dyes and pigments of the class known as "daylight fluorescent" materials is known for producing colors of longer wavelength than the emission color of the electroluminescent lamp, per se. Typical dyes available under the trade designation "Rhodamine B" and "Rhodamine 6G" have been used to produce the phenomenon known as "cascade excitation" wherein the emission of light from an electroluminescent lamp upon a photoluminescent dye produces a light in the visible spectrum having a particular spectral distribution for providing a specified color. The use of such techniques have been confined to the production of colors not normally readily available from electroluminescent lamps, such as red, or for permitting the use of a single phosphor, producing usually a green color, to produce multi-colored displays and pictures. However, no use of such materials has ever been made or suggested for narrowing spectral distribution.

In accordance with the invention, an electroluminescent lamp having a relatively broad spectral distribution is utilized in conjunction with a first fluorescent material, the emission spectrum of which may overlap the emission spectrum of the electroluminescent material. Those portions which overlap permit the free transmission of electroluminescent light without exciting the fluorescence of the dye. Further, portions of the electroluminescent emission having shorter wavelengths are absorbed by the dye which then fluoresces at longer wavelengths within the emission spectrum of the dye. Many such dyes are available for providing sufficient narrow spectral emission for safelight applications.

However, at the same time, the absorption spectrum of such dyes is normally equally as narrow as the emission spectrum thereof. Therefore, if excited by a broad spectral distribution light source, such as an electroluminescent lamp, light of wavelengths shorter than the absorption region of the dye is not absorbed and will be present in the overall emission spectrum of the lamp. This unadsorbed short wavelength emission is not permissible in a safelight application because such light causes fogging of the film. In accordance with one particular embodiment of the invention, the undesirable fogging resulting from the presence of unabsorbed short wavelength emission can be prevented by utilizing an appropriate filter in the form, for example, of a plastic film positioned over the electroluminescent lamp and the first fluorescent material. The filter is selected to prevent the passing therethrough of the unabsorbed light while permitting the transmission of light which has been emitted over the desired narrow spectrum required for effective safelight applications.

In further accord with the teachings of the invention, the undesirable fogging can also be prevented without the need for such a filter by using a second fluorescent dye having adsorption characteristics such that it absorbs that portion of the electroluminescent emission which is not absorbed by the first dye. Further, the characteristics of the second dye are such that it then fluoresces at wavelengths which are absorbed by the first dye, which latter dye in turn fluoresces at the desired wavelength as discussed above. Thus, the absorption spectrum is broadened without a corresponding broadening of the emission spectrum.

By the use of an electroluminescent lamp in conjunction with appropriately selected photoluminescent fluorescent materials, in accordance with the invention, it is possible to design a safelight lamp having a relatively narrow emission spectral distribution not hitherto available for use in safelight applications.

A more detailed description of the invention is shown and described with reference to the accompanying drawings wherein:

FIG. 2 shows a view in section of one exemplary embodiment of the invention;

FIG. 3 shows a view in section of an alternate exemplary embodiment of the invention;

FIGS. 4 – 6 show curves of relative light intensity vs. wavelengths useful in explaining the operation of a particular embodiment of the invention; and FIG. 7 shows a view in section of a further alternate exemplary embodiment of the invention.

The invention can best be understood by considering the principle of operation thereof before describing specific embodiments of the structure wherein such principles are utilized. The principles can best be illustrated by the graphical and idealized presentation of FIG. 1.

Figure 1:
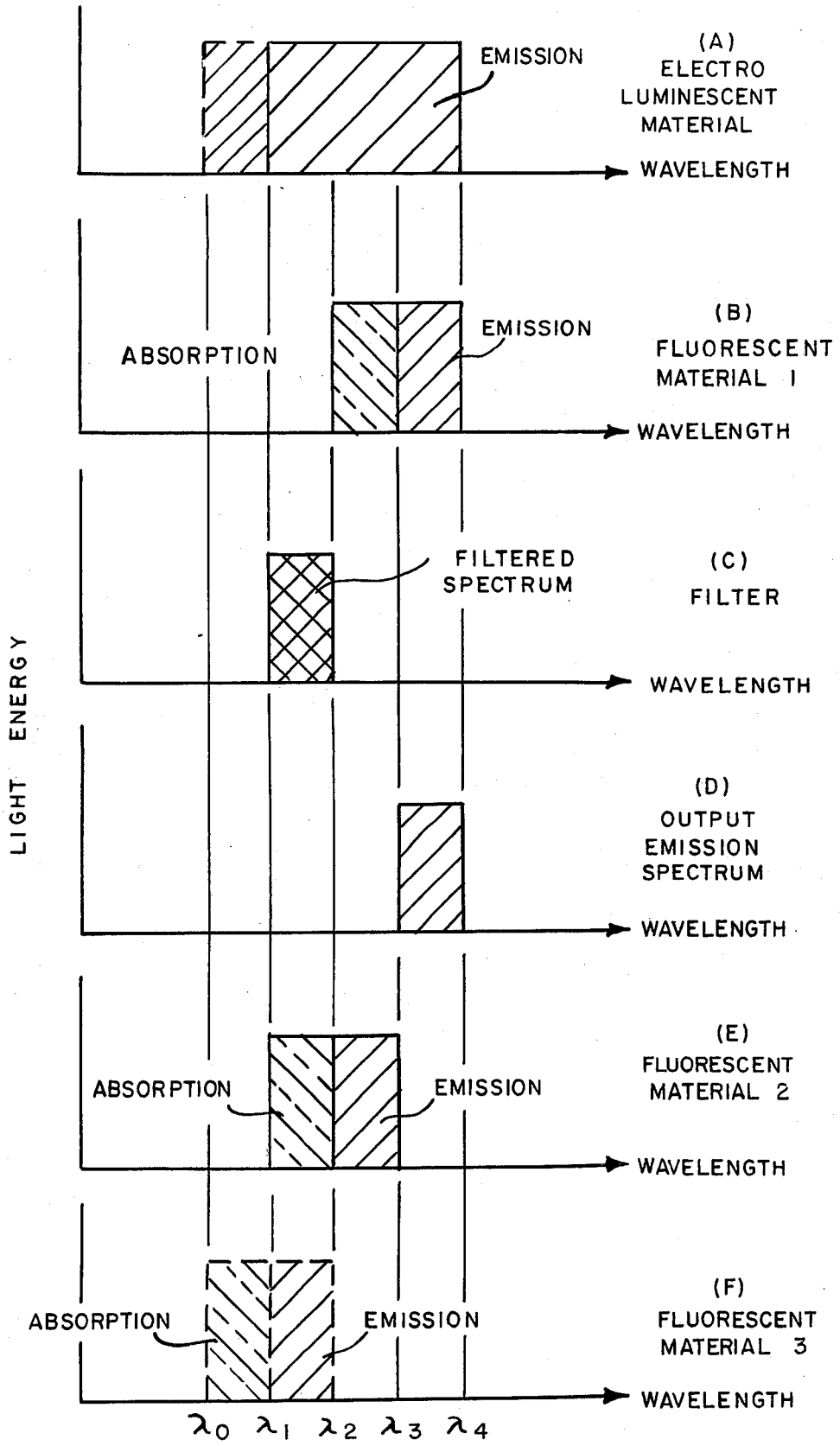
FIG. 1 shows a plurality of idealized graphical representations of the absorption and emission spectra of various materials in accordance with the invention.

In accordance therewith, let it be assumed that the emission spectrum of a selected electroluminescent material provides an emission of light having wavelengths in the visible region of the spectrum extending from a wavelength λ1 to the wavelength λ4, as shown by that portion of the spectrum enclosed by the solid line in part (A) of FIG. 1. Let if further be assumed that it is desirable to produce a light output from a lamp only over a range of wavelengths from wavelength λ3 to wavelength λ4.

In accordance with the invention, a first selected fluorescent material (identified as fluorescent dye material No. 1) has an emission spectrum extending from λ3 to λ4 and an adsorption spectrum extending from λ2 to λ3. When fluorescent dye material No. 1 is utilized in conjunction with the selected electroluminescent material, the portion of energy emitted by the electroluminescent material within the spectral range from λ2 to λ3 is absorbed by fluorescent dye material No. 1. The absorption of such energy in turn causes the dye to fluoresce so as to cause emission in the spectral region from λ3 to λ4. The energy emitted by electroluminescent material in the region from λ3 to λ4 is freely transmitted without absorption by fluorescent dye material No. 1. and, accordingly, such energy does not so excite the dye.

The energy emitted by the electroluminescent material in the region from λ1 to λ2 however, is not absorbed by fluorescent dye material No. 1, since the absorption spectra of the latter material only extends between λ2 and λ3. Accordingly, such energy also will be transmitted freely and since it is outside the desired emission spectrum range, it can cause a fogging of film being processed. To avoid such problem, in one particular embodiment of the invention, a filter having characteristics such that light having wavelengths over the range from λ1 to λ2 is not permitted to pass therethrough as shown in Part (C) of FIG. 1, is used in conjunction with the electroluminescent material and fluorescent dye. Accordingly, the light emission output occurs only over the range from λ3 to λ4, as shown in Part (D) of FIG. 1.

In an alternative embodiment of the invention, the need for a filter to be used together with the fluorescent dye in order to narrow the output emission spectrum may be avoided by the use of a second fluorescent dye material having an absorption spectrum over the range from λ1 to λ2 and an emission spectrum over the range from λ2 to λ3, as shown in part (E) of FIG. 1, in further combination with the electroluminescent material and the first fluoroscent dye material. The second fluorescent material can then absorb the previously unabsorbed energy in the spectrum range from λ1 to λ2 thereupon causing the second dye to fluoresce and produce an emission of energy in its emission spectrum from λ2 to λ3. Such energy emission is thereupon absorbed by fluorescent dye material No. 1 which then fluoresces to emit such absorbed energy in its emission range from λ3 to λ4 as desired. Accordingly, the overall material, utilizing the electroluminescent material and the two fluorescent materials as so selected, provides a total light emission output only in the portion of the spectrum from λ3 to λ4, again as shown in part (D) of FIG. 1.

The above concept can be carried further if the overall emission spectrum of the electroluminescent material is even broader and, for example, includes additional energy emission in the range of from λ0 to λ1 as shwon by the portion of the spectrum enclosed by a dashed line in part (A) of FIG. 1. In such a case, a filter as discussed above can be selected for use with a lamp which incorporates fluorescent dye material No. 1 to prevent the passage of light over the spectrum range from λ0 to λ2, thereby providing an output emission spectrum over the range from λ3 to λ4 as desired. Alternatively, to avoid the use of such a filter, a third fluorescent material (identified as fluorescent material No. 3) can be used in conjunction with the first and second fluorescent materials discussed above. Fluorescent material No. 3 can be selected to absorb energy in the spectrum range from λ0 to λ1 which material in turn fluoresces to provide emission in a spectrum range from λ1 to λ2 as shown in part (F) of FIG. 1. The latter energy is then absorbed by fluorescent material No. 2 which in turn fluoresces to convert such energy to an emission in its emission range from λ2 to λ3 which energy is in turn absorbed by fluorescent material No. 1 and results in an emission in the desired range from λ3 to λ4. The cascading of the characteristics of such multiple fluorescent materials results in an output emission spectrum over the range of from λ3 to λ4 as desired.

Such cascading may be continued with further fluorescent materials in accordance with the teachings of the invention if the original emission spectrum of the electroluminescent material is braod enough to require it. Further, an appropriate filter may alternatively be used at any stage in the cascading process together with one or more fluorescent materials as desired.

While the graphical representations of the absorption and emission spectra of the various fluorescent materials and the emission spectra of the electroluminescent material are shown in idealized from in FIG. 1, in practice the absorption and emission ranges are obviously not so exactly defined and an appropriate selection of the materials within the inventive concept must be made as best as possible in practical circumstances.

One example of the use of the inventive concept in a practical configuration is shown in FIG. 2 wherein an electroluminescent lamp contains a phosphor which is comprised of a combination of zinc sulfide and zinc selenide, there being a ratio by weight of ZnS to ZnSe of 80:20. Such combination is then doped with bromine and copper so as to provide an electroluminescent material emitting light at a peak wavelength of 550 nanometers, substantially over a spectrum from 450 nanometers to about 650 nanometers. The lamp comprises a layer of the above phosphor and a pair of conductive layers 11 and 12, the bottom or "back" electrode layer 11 being a layer of aluminum foil, for example, and the light-transmitting electrode layer 12 being, for example, glass fibers coated with a thin film of material such as tin oxide. The lamp is thereupon combined with an acrylic plexiglass sheet 13 which is placed over the light transmitting layer 12, all the layers being appropriately encased in a housing 14.

Similar arrangements may be used, as shown in FIG. 3, wherein the electroluminescent lamp layers are appropriately encased between a pair of acrylic plexiglass sheets which are thereupon appropriately sealed at the ends. In both instances, in FIG. 2 and FIG. 3, appropriate connectors (for covenience not shown here) are connected to electrode layers 11 and 12 and, thence, to an appropriate source of AC voltage, in a manner well known to those in the art.

A specific lamp made in accordance with FIGS. 2 and 3 can use, for example, an acrylic plexiglass sheet of the type sold under the designation 411–5 Acrylite, an acrylic plastic sheet containing a fluorescent dye, which sheet is manufactured and sold by American Cyanamid Co. Industrial Chemicals and Plastics Division, Wayne, New Jersey. The use of this commercialy available acrylic sheet containing a fluorescent dye is found to provide an output light spectrum which is substantially equivalent to that of a conventional safelight which employs an Eastman Series 8 safelight filter. Such a lamp as shown in FIGS. 2 and 3 can be successfully used to process Eastman Colored Print Film, Type 5385, without fogging, at intensity levels which are comparable to a conventional filtered incandescent safelight and which have the advantages discussed above with respect to the use of an electrolumiescent light structure.

Figure 4:
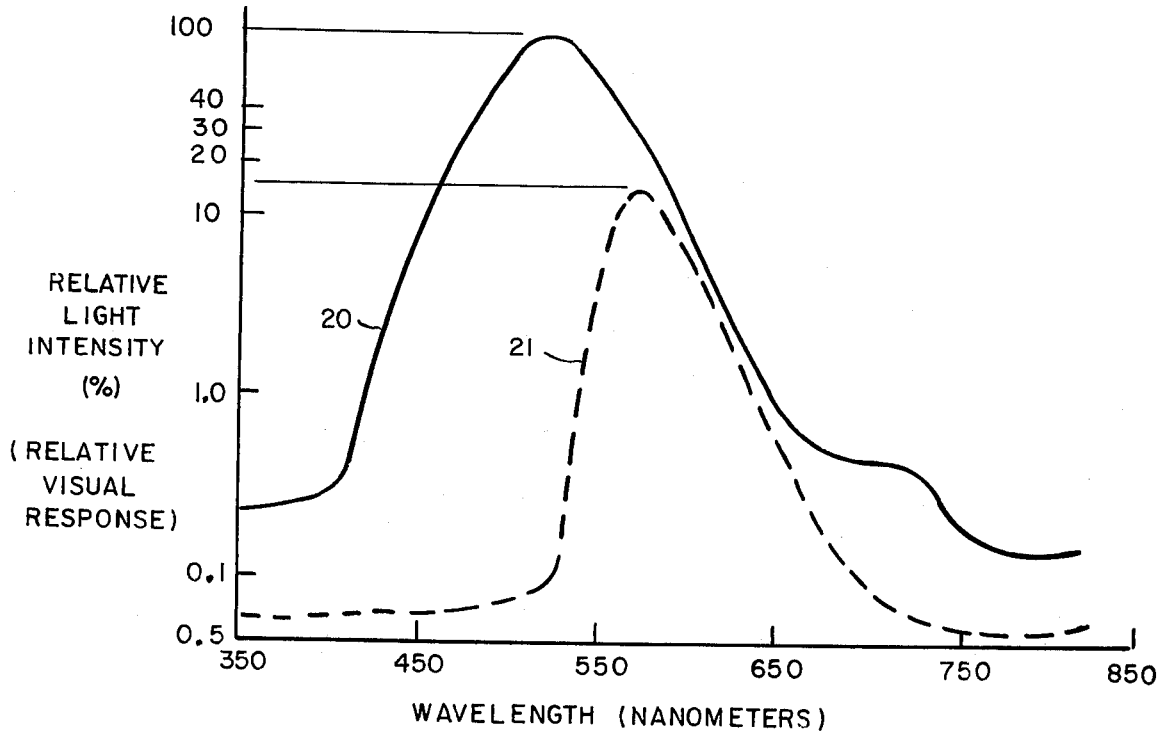
Figure 5:
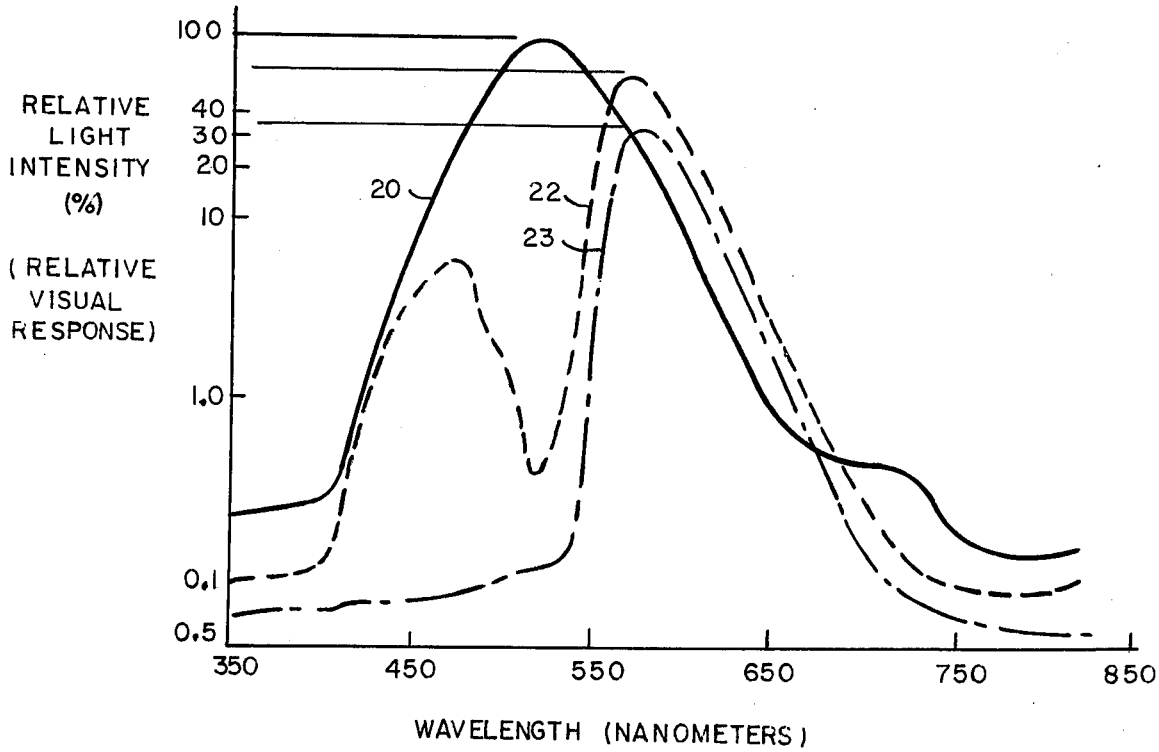

The operation and advantages thereof can be best understood in connection with the curves shown in FIGS. 4–6, which depict relative light intensities on a logarithmic scale as a function of wavelength on a linear scale. As seen in FIG. 4, an electroluminescent lamp structure as described above, for example, without the use of the acrylic plastic sheet shown in FIGS. 2 and 3, provides a relative visual response (i.e., a relative light intensity therefrom) over a wavelength spectrum shown by the solid line 20. For example, the response peaks at about 525 nanometers (defined as 100%) and falls to less than one percent of its peak value at wavelengths less than about 400 nanometers or greater than about 650 nanometers. If it is desired that such material be used in a safelight to provide light output only over a range which extends from about 550 nanometers to about 650 nanometers (as in a conventional Eastman Series 8 Filter) a filter can be used directly with the unmodified electroluminescent structure as suggested, for example, by the prior art. The use of a standard Ulano Amberlith filter manufactured and sold by Ulano Graphic Art Supplies, of Brooklyn, New York, for such purpose, for example, produces a relative light intensity as shown by dashed line 21 which, while it produces a spectrum substantially equivalent to the desired spectrum, reduces the relative light intensity therefrom to less than 15% of its level without the filter, a level which is generally too low to be satisfactory for the safelight application desired. In accordance with the invention, however, a comparable light output spectrum can be achieved at a much higher light intensity level as discussed below with reference to the curves shown in FIG. 5. As seen therein, for convenience, curve 20 of FIG. 4 has been reproduced in FIG. 5 and, as indicated above, represents the light intensity from an electroluminescent structure above. The electroluminescent structure can be provided with an acrylic plastic sheet thereover as shown by the structures of FIGS. 2 and 3. Such a sheet may be the above mentioned 411–5 Acrylite sheet, for example, the output spectrum of the combination as shown by such dashed line 22 in FIG. 5.

The absorption spectra of the fluorescent dye which is combined in the acrylic sheet material extends over a range from about 500 to about 550 nanometers, while its emission spectra extends from about 550 to 650 nanometers, the desired range of operation. Hence, the light output over the latter region is enhanced. However, the region from about 425 nanometers to about 500 nanometers is not absorbed and would, if not removed, produce undesirable film fogging. As discussed above, the use of a filter such as the Ulano Amberlith filter mentioned above, in combination with such an acrylic sheet, provides for the substantial elimination of the light output over the latter region without substantially affecting the output light intensity over the desired region. Such a structure is depicted, for example, in FIG. 7 wherein the filter element 14 is placed above the dye-containing acrylic sheet 13.

Accordingly, the overall relative light intensity level of such combination is shown by dash-dot line 23 of FIG. 5. When the latter curve is directly compared with curve 21 of FIG. 4 as in FIG. 6, it can be seen that the peak light intensity offered by a structure in accordance with the invention as in FIG. 7, is over 30% of that of the electroluminscent structure alone and, thus, is more than double that provided by the use of a filter alone.

Alternatively, in accordance with the invention, the results achieved by the use of a structure as in FIG. 7 can be effectively obtained without the need for filter element 14. In such a case, as broadly discussed above, a second fluorescent dye may be directly added to the dielectric phosphor layer of the electroluminescent structure in order to absorb the region of the spectrum which is not absorbed by the first fluorescent dye. The emission spectrum of the second fluorescent dye extends generally over the absorption spectrum region of the first fluorescent dye and the cascaded action provides an output similar to that achieved by the structure of FIG. 7. Thus, as in FIGS. 2 and 3, for example, an acrylic sheet, such as 411–5 Acrylite, is used with an electroluminescent structure in which the dielectric region of the latter contains a fluorescent dye made and sold under the designation of Rhodamine 6G. For example, the fluorescent dye can have a concentration of about one part thereof to about 1,000 parts of dielectric, by weight. The overall output light intensity from such a structure will be substantially similar to that shown by curve 23 of FIGS. 5 and 6.

Since a wide range of phosphors and fluorescent dyes are available, structures in accordance with the invention can be fashioned to satisfy a wide range of application, the phosphors and dyes being suitably selected to provide the desired light output spectrum from a knowledge of the absorption and emission spectra thereof.

For example, in order to provide a structure which is substantially equivalent to a Wratten No. 10 safelight filter, a lamp constructed in accordance with the invention can utilize a structure of the type shown in FIGS. 2 and 3 having an acrylic plastic sheet containing a first fluorescent dye of the type designated as 216–4 Acrylite made and sold by American Cyanimid Co. A second fluorescent dye such as the Rhodamine 6G discussed above can be added to the dielectric of the electroluminescent structure in a concentration as set forth above so that the overall structure provides a light output substantially equivalent to that of a conventional Wratten 10 filter.

In the above structures, the fluorescent dyes are dispersed throughout an acrylic plastic sheet or incorporated in the phosphor dielectric material of the electroluminescent structure itself. Further, such dyes may be incorporated as a pigment or dye in a separate film overlay which is placed between the light-transmitting lamp electrode and an acrylic plastic sheet. The dye layer may alternatively be affixed to the external surface of the electrode as a coating of paint rather than as a plastic film overlay. The electroluminescent structure may merely be placed behind the acrylic sheet in contact therewith within a housing or it may be laminated at one surface directly to the sheet in the configuration of FIG. 2. Further, in accordance with FIG. 3, it may be laminated between such layers.

In all cases, the use of electroluminescent lamps provides advantages of convenience and reproducibility and provides a structure the physical dimensions of which permits use thereof as an unsupported structural unit. Further, the overall unit may be made dimensionally similar to existing glass safelight filters so that they can be retrofitted to existing fixtures to replace incandescent bulb and filter combinations. The safelight structures of the invention can be utilized with standard 60 Hertz, 220 or 270 volt sources to provide adequate intensities. Under certain conditions, structures using conventional 60 Hertz, 115 volt sources may be used.

Further, the lamps may be made in flexible form with flexible film overlays and in such form may be used, for example, to wrap around poles, to mark dials, control knobs, buttons, etc. to indicate the presence of obstructions, to illuminate passageways, and the like, without fogging film which is being processed in the vicinity thereof, which lamps can then fulfill many new functions not readily filled by presently available incandescent lamps using safelight filters.

If desired, the lamps of the invention may also include a further moisture barrier layer which encases the overall structure described above. One moisture barrier layer which is often used in electroluminescent lamps of the prior art for creating such a moisture impervious structure is in the form of a polychlorotrifluoroethylene film, one such film material being sold, for example, by Allied Chemical Co. under the trademark "Aclar."Other vapor barriers and dessicants may be included in the structure of the lamp of the invention within the intended scope thereof.

While the specific embodiments described above are illustrative of the invention, others may occur to those in the art within the spirit and scope of the invention. Hence, the invention is not to be construed as limited thereto, except as defined by the appended claims.

What is claimed is:

1. A lamp assembly comprising electroluminescent means including a layer of electroluminescent material disposed between a light-reflective electrode and a light-transmitting electrode for emitting light over a first pre-determinable range of the visible spectrum;

first pre-selected fluorescent means positioned in responsive relation to said electroluminescent material for absorbing light emitted by said electroluminescent means over a first portion of said first pre-determinable range and for emitting said absorbed light over a second pre-determinable range which is narrower than said first pre-determinable range; and further means positioned in responsive relation to said electroluminescent material for absorbing light over another portion of said first pre-determinable range;

whereby substantially all of the light emitted by said lamp assembly lies within said second narrower predeterminable range.

2. A lamp assembly in accordance with claim 1 wherein said further means comprises a filter means positioned externally to said electroluminescent means in responsive relation to said electroluminescent material.

3. A lamp assembly in accordance with claim 1 wherein said further means comprises a second pre-selected fluorescent means for absorbing light over said another portion of said first pre-determinable range and for emitting light substantially over said first portion thereof.

4. A lamp assembly in accordance with claim 1 wherein said first pre-selected fluorescent means is positioned in external responsive to said electroluminescent material and opposite at least said light-transmitting electrode.

5. A lamp assembly in accordance with claim 4 wherein said first pre-selected fluorescent means is positioned in external responsive relation to said electroluminescent material and opposite both said light reflective electrode and said light transmitting electrode, said electroluminescent means being substantially enclosed by said first pre-selected flourescent means.

6. A lamp assembly in accordance with claim 5 wherein said further means comprises a filter means positioned external to and opposite said first pre-selected fluorescent means.

7. A lamp assembly in accordance with claim 6 wherein said first pre-selected fluoroescent means comprises a plastic film overlay having a first pre-selected fluorescent material incorporated therein, said overlay comprising a pair of laiminated sheets of acrylic plastic which substantially encase said electroluminscent means.

8. A lamp assembly in accordance with claim 4 wherein said further means comprises a filter means positioned external to and opposite said first pre-selected fluorescent means.

9. A lamp assembly in accordance with claim 4 wherein said further means comprises a second pre-selected fluorescent means positioned in responsive relation to said electroluminescent material for absorbing light over said another portion of said first pre-determinable range and for emitting light substantially over said first portion thereof.

10. A lamp assembly in accordance with claim 4 wherein said first pre-selected fluorescent means comprises a plastic film overlay having a first pre-selected fluorescent material incorporated therein, said plastic overlay being positioned external to and opposite said light transmitting electrode.

11. A lamp assembly in accordance with claim 10 wherein said plastic film overlay comprises at least one sheet of acrylic plastic having said first pre-selected fluorescent material incorporated therein.

12. A lamp assembly in accordance with claim 11 wherein said further means comprises a filter means positioned external to and opposite said acrylic sheet.

13. A lamp assembly in accordance with claim 11 wherein said further means comprises a second pre-selected fluorescent means for absorbing light over said another portion of said first determinable range and for emitting light substantially over said first portion thereof, said second pre-selected fluorescent means being incorporated in said layer of electroluminescent material.

14. A lamp assembly in accordance with claim 4 wherein said first pre-selected fluorescent means is in the form of a coating of a first pre-selected fluorescent material disposed on the exposed surface of said light transmitting electrode.

* * * * *